US010902827B2

(12) United States Patent
Tracy

(10) Patent No.: US 10,902,827 B2
(45) **Date of Patent: *Jan. 26, 2021**

(54) GUITAR BRIDGE ASSEMBLY WITH STRING-SPECIFIC SADDLES AND STOPBAR

(71) Applicant: ADVANCED PLATING, INC., Nashville, TN (US)

(72) Inventor: Steve Tracy, Gallatin, TN (US)

(73) Assignee: ADVANCED PLATING, INC., Nashville, TN (US)

( * ) Notice: Subject to any disclaimer, the term of this patent is extended or adjusted under 35 U.S.C. 154(b) by 25 days.

This patent is subject to a terminal disclaimer.

(21) Appl. No.: 15/913,405

(22) Filed: Mar. 6, 2018

(65) Prior Publication Data

US 2018/0197510 A1 Jul. 12, 2018

Related U.S. Application Data

(63) Continuation of application No. 14/222,265, filed on Mar. 21, 2014, now Pat. No. 9,922,625, which is a continuation of application No. 13/350,329, filed on Jan. 13, 2012, now Pat. No. 8,723,007.

(60) Provisional application No. 61/433,005, filed on Jan. 14, 2011.

(51) Int. Cl.
*G10D 3/04* (2020.01)

(52) U.S. Cl.
CPC ..... *G10D 3/04* (2013.01)

(58) Field of Classification Search
CPC ..... G10D 3/04
See application file for complete search history.

(56) References Cited

U.S. PATENT DOCUMENTS

| | | | | |
|---|---|---|---|---|
| 3,437,001 | A | 4/1969 | Kraft | |
| 5,285,710 | A | 2/1994 | Chapman | |
| 5,739,444 | A | 4/1998 | Borisoff | |
| 6,613,968 | B1 | 9/2003 | Devereaux et al. | |
| 6,686,523 | B1 | 2/2004 | Devereaux et al. | |
| 9,922,625 | B2 * | 3/2018 | Tracy | G10D 3/04 |
| 2006/0162528 | A1 | 7/2006 | Kinoshita | |
| 2009/0314152 | A1 | 12/2009 | Shamblin | |
| 2010/0005944 | A1 | 1/2010 | Eliasson | |
| 2013/0055876 | A1 | 3/2013 | Mason | |
| 2013/0186255 | A1 | 7/2013 | McCabe | |

(Continued)

OTHER PUBLICATIONS

Premier Guitar; Jan. 2008; pp. cover, 82, 83.

(Continued)

*Primary Examiner* — Kimberly R Lockett
(74) *Attorney, Agent, or Firm* — Greenblum & Bernstein, P.L.C.

(57) ABSTRACT

An adjustment post assembly for a bridge for a stringed instrument, the adjustment post assembly having a lower portion configured for insertion in a cavity of the stringed instrument and having an internally-threaded bore and an upper portion having a threaded portion structured and arranged for threaded engagement with the internally-threaded bore and a bridge post configured for supporting one end of the bridge. The bridge post includes a socket therein structured and arranged for adjusting a height of the upper portion relative to the lower portion.

18 Claims, 10 Drawing Sheets

(56) References Cited

U.S. PATENT DOCUMENTS

2018/0033412 A1* 2/2018 Colas ..... G10D 3/04

OTHER PUBLICATIONS

Guitar Player; Feb. 2007; pp. cover, 120, 121.
Guitar Player: Jun. 2008; pp. cover.
Internet Archive screen shot from www.jag-stang.com/guitars/the-tune-o-matic-bridge/, dated Nov. 30, 2009 (link: https://web.archive.org/web/20091130132315/https://www.jag-stang.com/guitars/the-tune-o-matic-bridge/), 1 page.
Internet Archive screen shot from www.stwemac.com:80/shop/Bridges_tailpieces/Electric_guitar,_Tune-o-matic_bridges/TonePros_Locking_Guitar_Hardware.html, dated Oct. 12, 2004 (link: https://web.archive.org/web/20041012032725/http://www.stewmac.com:80/shop/Bridges,_tailpieces/Electric_guitar,_Tune-o-matic_bridges/TonePros_Locking_Guitar_Hardware.html), 1 page.

* cited by examiner

SADDLES AND STRINGS
ISO VIEW

SADDLES
ISO VIEW

STRINGS SIZE

STRINGS ANGLE

| STRING GAP (EXEMPLARY) | | |
|---|---|---|
| POSITION | GAP A | GAP B |
| E | 0.003 | 0.005 |
| A | 0.003 | 0.005 |
| D | 0.002 | 0.003 |
| G | 0.001 | 0.002 |
| B | 0.001 | 0.001 |
| e | 0.001 | 0.001 |

700
715
740

715
705
700
710

720
725
710

715
735
740
705
730

GUITAR BRIDGE ASSEMBLY WITH STRING-SPECIFIC SADDLES AND STOPBAR

CROSS REFERENCE TO RELATED APPLICATIONS

The present application is a continuation of U.S. patent application Ser. No. 14/222,265 filed on Mar. 21, 2014, which is a continuation of U.S. patent application Ser. No. 13/350,329 filed on Jan. 13, 2012, and claims the benefit of U.S. Provisional Application No. 61/433,005 filed on Jan. 14, 2011, the disclosures of which are expressly incorporated by reference herein in their entireties.

BACKGROUND OF THE INVENTION

1. Field of the Invention

This invention relates to guitar bridges and stopbars and more particularly to string specific saddles for a guitar bridge, and rigidly mounted guitar bridges and stopbars (or tailpieces) that become fixedly mounted to the body of a guitar. Additionally, the present invention relates to guitar components having universally sized screws to allow for adjustment thereof via a universally sized adjustment tool.

2. Description of the Related Art

Steel string guitars generally have separate structures in the string system. These structures must be carefully installed and aligned for the strings to accurately reproduce the desired notes upon being plucked or strummed.

As shown in FIG. 1, a tailpiece 100 is mounted on a body of an exemplary 6-string guitar and holds one end of strings 102, 104, 106, 108, 110, and 112. The tailpiece 100 provides the mechanical strength for the tension of the stretched strings against the body of the guitar. These strings 102, 104, 106, 108, 110, and 112 then pass over a bridge 120, which is used to initially set the tuning of the guitar so the guitar plays in tune with the proper tone and timbre. The bridge includes a number of saddles (e.g., one for each string), wherein each string passes over a respective saddle. Each saddle is similarly constructed and may include a uniformly-sized notch, through which the string passes to hold its respective string above the bridge and guitar at a desired height. Alternatively, the saddle may have no notches at all. The position of each saddle (within the bridge) along the length of the guitar (i.e., in a string extension direction) may be altered to adjust the intonation of each string. Conventional saddles, however, are not string-specific (i.e., configured to accommodate a specific string size (or size range)), and thus, may require additional adjustment in order to properly set each desired string height. Moreover, as conventional saddles are not string-specific, conventional saddles do not provide an optimum fit for each of the strings. That is, as conventional saddles are provided with a single size notch for each of the six saddles, a smaller diameter string (e.g., a B-string) will sit lower in its respective saddle notch, than a larger diameter string (e.g., a low E-string) in its respective saddle notch having the same size. Conversely, with conventional saddles, the larger diameter string (e.g., a low E-string) will sit higher (and less securely) in its respective saddle notch, than a smaller diameter string (e.g., a B-string).

In an electric guitar, the strings 102, 104, 106, 108, 110, and 112 will also pass over one or more magnetic or other types of pickups 130. The pickups 130 are used to convert the physical vibrations of the strings 102, 104, 106, 108, 110, and 112 into electrical energy which can then be electrically amplified.

The strings 102, 104, 106, 108, 110, and 112 then extend over, but do not contact, multiple frets (not shown) on the guitar. Towards a neck of the guitar, the strings 102, 104, 106, 108, 110, and 112 then pass over a nut (not shown) to tuning pegs (not shown). The tuning pegs are adjustable to increase or decrease the tension of each respective string 102, 104, 106, 108, 110, and 112. This raises or lowers the frequency of the tone of each string so that the proper notes are heard upon plucking or strumming the guitar. Between the nut and the bridge 120 are the various frets between which the strings 102, 104, 106, 108, 110, and 112 are depressed so that the effective length of the string is shortened to thereby increase the frequency at which that particular string vibrates.

An important factor in a quality electric guitar is the guitar sound. The material of the body, the quality of the magnetic or other pickups (e.g., piezo pickups), the rigidity of the guitar itself, the accuracy of the placement and spacing of the strings 102, 104, 106, 108, 110, and 112 above the fingerboard and associated frets, the actual placement of the frets, and the quality of the tuning bridge 120 are all important to the overall sound of the guitar.

The strings 102, 104, 106, 108, 110, and 112 are stretched initially between the bridge 120 and the nut just to tune the strings 102, 104, 106, 108, 110, and 112 to their proper respective note. Then the strings 102, 104, 106, 108, 110, and 112 are stressed further by a guitar player, upon playing, by forcing the strings 102, 104, 106, 108, 110, and 112 down onto the fingerboard between frets. Because of the energy with which some players play their guitars, the strings 102, 104, 106, 108, 110, and 112 stretch and often have to be replaced daily or even while playing. This requires that the strings 102, 104, 106, 108, 110, and 112 be removed from the tuning pegs, the body of the guitar, and the tailpiece 100, respectively.

With prior art devices, since the bridge 120, and possibly the stopbar (or tailpiece) 100, may only be held in place by the tension of the strings 102, 104, 106, 108, 110, and 112, the replacement of the strings 102, 104, 106, 108, 110, and 112 required that the entire guitar be completely retuned every time a string or strings are replaced.

Also, with prior art devices, when all of the guitar strings 102, 104, 106, 108, 110, and 112 are removed, the bridge 120 became freely removable. In order to address this, it has been known to secure the bridge and/or tailpiece to the guitar through screws inserted in a direction parallel to the string length through the bridge to contact securing posts on which the bridge is mounted. Prior art methods, however, do not provide for optimum securing of the bridge to the guitar. Additionally, with prior art methods, the screws securing the bridge to the guitar are difficult to access, which may cause a guitarist to damage their guitar when making such adjustments.

Furthermore, with prior art methods, different adjustments of the bridge and/or tailpiece components require different tools. For example, a tool for securing the bridge to the posts of the guitar would not be useable to, e.g., adjust the height of a particular saddle. Thus, a guitarist would need to carry a plurality of tools in order to be able to make all of the different adjustments to the bridge and/or stopbar (or tailpiece).

Therefore, there is a need for an improved system and method for providing a bridge and tailpiece for a guitar.

SUMMARY OF THE INVENTION

The present invention provides string-specific saddles for a guitar bridge, and rigidly mounted guitar bridges and tailpieces that become fixedly mounted to the body of a guitar. Additionally, each of the saddles, the guitar bridge and the tailpiece allow for adjustment thereof via a universally sized adjustment tool. More specifically, in embodiments, the present invention provides string-specific saddles which are configured and optimized for a specific string size (diameter), or size range. For example, with a six-string guitar, the notch of each saddle is sized differently based on the string size that that saddle will accommodate.

Additionally, in embodiments, the present invention provides an improved stabilizing screw arrangement for securing the bridge and stopbar (or tailpiece) to the body of the guitar. The stabilizing screws (and the corresponding receiving holes of the bridge) are oriented to provide a force vector both along the direction of the strings (e.g., counter to the string tensioning direction) and perpendicular (or approximately perpendicular) to the direction of the strings. In accordance with additional aspects of the invention, the adjustment screws for the bridge and tailpiece are of a uniform size, such that a single tool (e.g., a 2 mm Allen wrench) is effective to make the different adjustments to the bridge and/or stopbar. Thus, for example, a user utilizing a single tool is able to make adjustments to the guitar including, for example: securing the bridge and stopbars to their respective posts on the guitar; adjusting the position of each saddle along the string length; and adjusting the height of each adjustment post (to which the bridge is secured), amongst other contemplated adjustments.

In embodiments of the invention, a stringed instrument bridge assembly is for a stringed instrument having a plurality of strings of different gauges. The bridge assembly comprises a stringed instrument bridge; and a plurality of string-specific saddles arranged within the stringed instrument bridge. Each of the plurality of string-specific saddles includes a respective notch structured and arranged for accommodating therein a respective string of the plurality of strings. Each of the respective notches is configured in a string-specific manner to accommodate therein a string at least one of: configured to produce a particular note, having specific string gauge, and within a range of string gauges configured to produce a particular note.

In further embodiments, each of the plurality of string-specific saddles comprises a differently sized notch.

In additional embodiments, each of the plurality of string-specific saddles includes an identifier of the respective particular note or the specific string gauge.

In embodiments, a width of an opening at a top of each respective notch is approximately 30% to 36% larger than a gauge of the respective string accommodated in each respective notch.

In further embodiments, the respective notches are structured and arranged to provide a spacing of approximately 15% to 18% of a width of an opening at a top of the respective notch on each side of a respective string when seated in its respective notch.

In additional embodiments, the stringed instrument bridge assembly further comprises two stabilizing screws to releaseably secure the stringed instrument bridge to the stringed instrument.

In embodiments, the two stabilizing screws are structured and arranged such that respective longitudinal axes of the two stabilizing screws are arranged at an angular offset relative to a string extension direction.

In further embodiments, the angular offset is approximately 45°±10° relative to a longitudinal axis of the bridge in a direction one of away from a nut of the guitar and towards the nut of the guitar.

In additional embodiments, each of the two stabilizing screws are structured and arranged to respectively provide a force vector acting in a direction approximately parallel to a string extension direction and a force vector approximately perpendicular to the string extension direction.

In embodiments, the two bridge stabilizing screws are structured and arranged to provide respective counteracting force vectors.

In further embodiments, the stabilizing screws each comprise an Allen screw having a 2 mm socket.

In additional embodiments, the stringed instrument bridge assembly further comprises a plurality of intonation screws, each of the plurality of intonation screws having a socket, and a plurality of adjustment posts, each of the plurality of adjustment posts having a socket. Each of the respective sockets of the plurality of intonation screws, the plurality of adjustment posts, and the stabilizing screws are structured having a commonly-sized socket to allow for adjustment thereof via a universally sized adjustment tool.

In embodiments, the stringed instrument bridge assembly is used in combination with a stringed instrument stopbar assembly. The stopbar assembly comprises a stopbar comprising stabilizing screw holes and two stopbar stabilizing screws to releaseably secure the stopbar to the stringed instrument, each of the two stopbar stabilizing screws having a socket. Each of the two stopbar stabilizing screws are structured and arranged to respectively provide a force vector acting in a direction approximately parallel to a string extension direction and a force vector approximately perpendicular to the string extension direction.

In further embodiments, each of the respective sockets of the stabilizing screws and the stopbar stabilizing screws are structured having a commonly-sized socket to allow for adjustment thereof via a universally sized adjustment tool.

In additional embodiments, a stringed instrument bridge assembly is for a stringed instrument having a plurality of strings of different gauges. The bridge assembly comprises a stringed instrument bridge comprising stabilizing screw holes; and two stabilizing screws to releaseably secure the stringed instrument bridge to the stringed instrument. Each of the two stabilizing screws are structured and arranged to respectively provide a force vector acting in a direction approximately parallel to a string extension direction and a force vector approximately perpendicular to the string extension direction.

In embodiments, the two stabilizing screws are structured and arranged such that respective longitudinal axes of the two stabilizing screws are arranged at an angular offset relative to a string extension direction. The angular offset is approximately 45°±10° relative to a longitudinal axis of the bridge in a direction one of away from a nut of the guitar and towards the nut of the guitar.

In further embodiments, the two stabilizing screws are structured and arranged to provide respective counteracting force vectors.

In additional embodiments, a stringed instrument stopbar assembly is for a stringed instrument having a plurality of strings of different gauges. The stopbar assembly comprises a stopbar comprising stabilizing screw holes and two stabilizing screws to releaseably secure the stringed instrument stopbar to the stringed instrument. Each of the two stabilizing screws are structured and arranged to respectively provide a force vector acting in a direction approximately parallel to a string extension direction and a force vector approximately perpendicular to the string extension direction.

In embodiments, the two stabilizing screws are structured and arranged such that respective longitudinal axes of the two stabilizing screws are arranged at an angular offset relative to a string extension direction. The angular offset is approximately 20°±10° relative to a longitudinal axis of the stopbar in a direction towards the nut of the guitar.

In further embodiments, the two stabilizing screws are structured and arranged to provide respective counteracting force vectors.

In additional embodiments, a stringed instrument bridge assembly is for a stringed instrument having a plurality of strings of different gauges. The bridge assembly comprises a stringed instrument bridge and a plurality of adjustment posts. Each of the plurality of adjustment posts comprises a socket structured and arranged for adjusting a height of the respective adjustment post.

In a further embodiment, a method of attaching a stringed instrument bridge assembly for a stringed instrument having a plurality of strings of different gauges to the stringed instrument, the method comprises attaching a plurality of adjustment posts to the stringed instrument, wherein each of the plurality of adjustment posts comprises a socket structured and arranged for adjusting a height of the respective adjustment post. The method also includes attaching a bridge assembly to the plurality of adjustment posts, wherein the bridge assembly comprises: two stabilizing screw holes angularly offset from a direction approximately parallel to a string extension direction and angularly offset from a direction approximately perpendicular to the string extension direction; and two stabilizing screws structured and arranged to releaseably secure the stringed instrument bridge to the plurality of adjustment posts. Additionally, the method includes fastening the two stabilizing screws in the respective stabilizing screw holes to secure the bridge assembly to the plurality of adjustment posts to provide a force vector acting in the direction approximately parallel to the string extension direction and a force vector in the direction approximately perpendicular to the string extension direction.

BRIEF DESCRIPTION OF THE DRAWINGS

For a more complete understanding of the invention, as well as other objects and further features thereof, reference may be had to the following detailed description of the invention in conjunction with the following exemplary and non-limiting drawings wherein.

Figure 1:
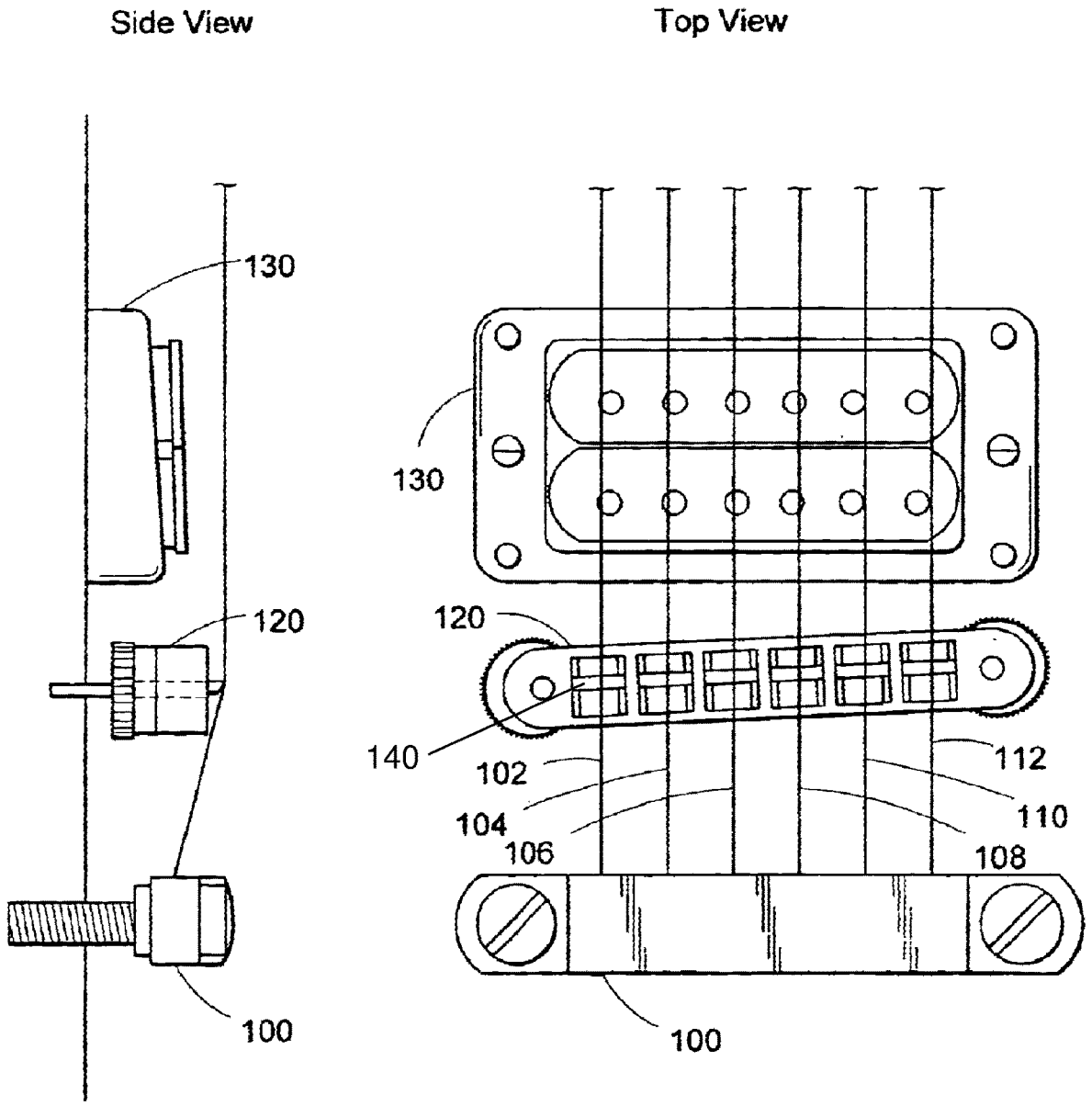
Figure 1 (Prior Art)
FIG. 1 is a top and side view of a conventional guitar upon which a guitar bridge and a stopbar (or tailpiece) have been mounted.

Reference numbers refer to the same or equivalent parts of the present invention throughout the various figures of the drawings.

DETAILED DESCRIPTION OF THE INVENTION

Embodiments of the present invention provide string specific saddles for a guitar bridge, and rigidly mounted guitar bridges and tailpieces that become fixedly mounted to the body of a guitar. Additionally, the present invention relates to guitar components having universally sized screws to allow for adjustment thereof via a universally sized adjustment tool. The present invention also provides for improving the sound from the guitar by creating a more solidly mounted system for coupling the strings to a resonating guitar body. The solid connection afforded by the disclosed invention allows for the guitar instrument to resonate better, thus transferring the sound to the instrument body and enhancing the played notes. The sound quality is also enhanced due to the solid adjustment of the bridge components allowing for increased harmonic overtone transfer to the instrument pickups.

After adjustment, as described hereinafter, the components are secured and cannot come loose even when the strings are removed, thereby preventing any damage to the instrument finish. Also, since the adjustments are secured, i.e., as the components do not come off or loosen during the string replacement process, there is no need to readjust the string components after string removal.

The components described herein are also designed to fit or retrofit most instruments without any modification to the original instrument. Even expensive "vintage" instruments can be fitted with the new components without any modification to the instrument, and the use of the new components does not detract from the "vintage" look of the instrument. The new components may be constructed to make visual detection of any difference between original stock components and the new components difficult. The new components are easy to use, install, and adjust by a purchaser. A professional installation and adjustment of the components is likely not needed after the first such installation and adjustment, as the instrument owner or user can perform the installation and maintenance.

String-Specific Saddles

In accordance with an aspect of the invention, a bridge is provided with string-specific saddles, in which each saddle has a "notch" sized to accommodate a specific string size (or range of sizes). By implementing the present invention, the bridge having string-specific saddles improves contact area between each string and its respective saddle, and provides better string stability giving the artist better feel during use. Additionally, string-specific saddles eliminate buzz that occurs from poor string to saddle contact area, and eliminate the loose feel of cords.

With a conventionally tuned six-string guitar, for example, the six strings are tuned as E, A, D, G, B and E from low note to high note. The low-E (or "E") string has the largest diameter and the high-E (or "e") string has the smallest diameter, with the intervening strings having respective intermediate sizes. According to aspects of the invention, each saddle has a notch that is sized to the appropriate string size establishing more precise (e.g., exact) string placement on guitar. In embodiments, the saddles may be sized or formed using computer numerical controlled (CNC) machining, or die-casting, amongst other contemplated manufacturing methods. Additionally, in embodiments, the saddle may comprise steel (e.g., stainless steel) or other suitable material.

In accordance with aspects of the invention, the string-specific saddle helps prevent poor string alignment to the pick-up. That is, as each saddle is string-specific, each string is more properly aligned with the pick-up, e.g., laterally (or along the bridge direction) and vertically above the pick-up. The string-specific notches help to maintain each string in its proper position, e.g., during playing when additional force is applied to the strings. For example, the present invention helps to prevent string jump, because strings fit precisely into their respective saddles. Constant string position improves performance and reliability of the guitar.

Additionally, the present invention provides precise height of string to pick-up distances for each of the strings for precise tuning. For example, with the present invention, the saddles and the notches can be configured such that all the strings are positioned to provide an equal distance from bottom of each respective string to the pick up. Additionally, for example, the saddles and the notches can be configured such that the strings are positioned to provide an equal distance from bottom of each respective string to the fret board. As is understood by those of ordinary skill in the art, the fret board may have a radius of curvature, such that the outer two strings (e.g., the high-E and the low-E strings) are slightly lower (i.e., closer to the pick up) than the two center strings (e.g., the D-string and the G-string), with the height of the two intermediate strings (e.g., the A-string and the B-string) positioned at a height between the other two pairs of strings. Additionally, the saddles and the notches can be configured such that the pairs of corresponding strings (i.e., the high-E and the low-E strings, the D-string and the G-string, and the A-string and the B-string) are positioned at the same height relative to one another. It should also be understood that, in order to position the strings to provide an equal distance from bottom of each respective string to the fret board, in embodiments, the saddles may have differing heights.

Known saddles, which include saddles having inconsistent notchings, saddles having all equal size notchings, or saddles having no notches, can result in drawbacks such as higher or lower strings (i.e., vertically misaligned strings). With the present invention, however, such drawbacks can be avoided. In embodiments, the saddles may be labeled by note for easy replacement. That is, the saddle configured for accommodating the A-string may be labeled with an "A."

Figure 2A:
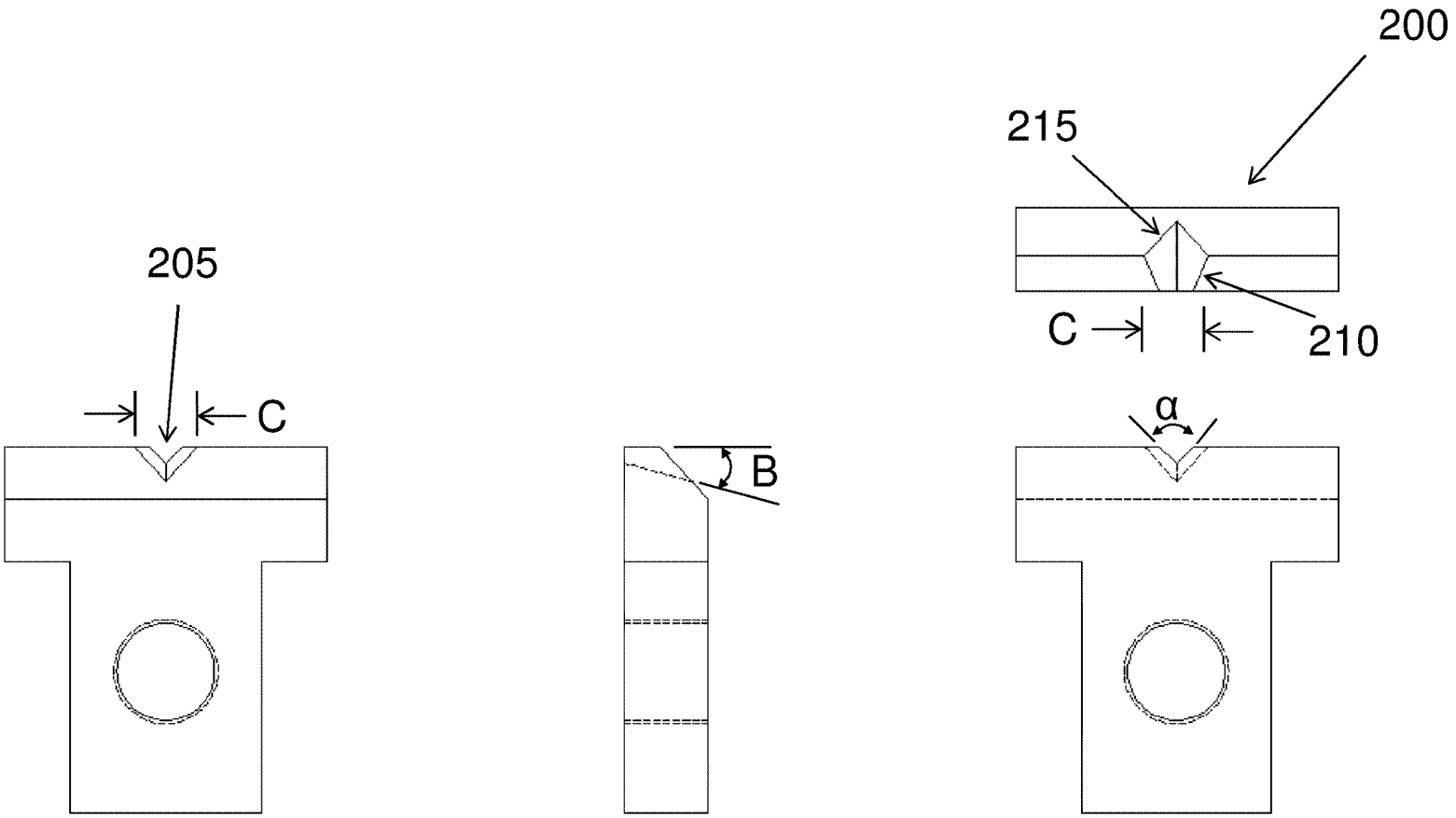
FIG. 2A illustrates top, side, back and front views of an exemplary saddle in accordance with aspects of the present invention.

FIG. 2A illustrates exemplary top, side, rear and front views of a saddle 240 in accordance with aspects of the present invention. As shown in FIG. 2A, the saddle 240 is provided with a notch 205 for accommodating a string (not shown) therein. In accordance with aspects of the invention, the notch 205 is specifically sized for a particular size string (e.g., the A-string). In embodiments, the notch 205 may comprise a "V" shape having an angle $\alpha$ of approximately 90°. While FIG. 2A illustrates the notch 205 as having a "V" shape, the invention contemplates other notch shapes, including, for example, a "U" shape, a half oval shape, and/or a semi-circular shape, amongst other notch shapes. Additionally, as shown in the exemplary embodiment of FIG. 2A, in embodiments, the notch 205 comprises a front notch portion 210 and a back notch portion 215 on the saddle 240. In accordance with aspects of the invention, the back notch portion 215 on the rear and the front notch portion 210 provide for improved string contact and the elimination of string buzz.

In accordance with aspects of the invention, in embodiments, each notch 205 may be sized having a width C at the top of the notch that is approximately 30% to 36% larger than the gauge of the string, such that a spacing of approximately 15% to 18% of the width C at the top of the notch 205 is provided on each side of the string when seated in the notch 205. In other words, the amount of space available (once the corresponding string is in place) between the string and the side of the notch, is 15%-18% (on either side) of the overall width at the top of the notch. For example, an exemplary standard gauge "e" string has a diameter of 0.010". With a non-limiting exemplary embodiment, the width C of the notch 205 for a corresponding "e" saddle would be 0.014". With this in mind, subtracting the 0.010" leaves a remainder 0.004" of space, or 0.002" on each side of the string, wherein 0.002"/0.014" is approximately 15%.

As shown in the side view of FIG. 2A, in embodiments, the notch 205 slopes downwardly at an angle B from the front (or nut) side 250 of the saddle 240 to the rear side 245 of the saddle. In embodiments, the angle B may range from approximately 4.5° to approximately 15.5°, and the sting specific saddles for the different strings may each have different values for the angle B. In accordance with aspects of the invention, the angle B is selected to provide a contact point towards the front edge of the saddle notch. This in turn minimizes string contact with the saddle. In accordance with aspects of the invention, the significance or extent of the saddle/string contact area is configurable by varying the slope of angle B.

Additionally, it should be understood that there are different gauges of strings (e.g., light, medium and heavy, etc.), wherein the heavier-gauged strings are larger in diameter than the lighter-gauged strings. As such, an A-string from a set of heavier-gauge strings will have a larger diameter than an A-string from a set of lighter-gauge strings. The invention contemplates, that in embodiments, the string-specific saddles will be sized to accommodate the range of diameters encompassed by the different gauges of strings. That is, in embodiments, the "A" saddle will be sized to properly accommodate, for example, both the A-string from the set of heavier-gauge strings and, alternatively, the A-string from a set of lighter-gauge strings. Additionally, the invention contemplates string-specific saddles that are configured to accommodate strings of a particular gauge, to provide even greater precision of contact between the strings and the saddles.

Figure 2B:
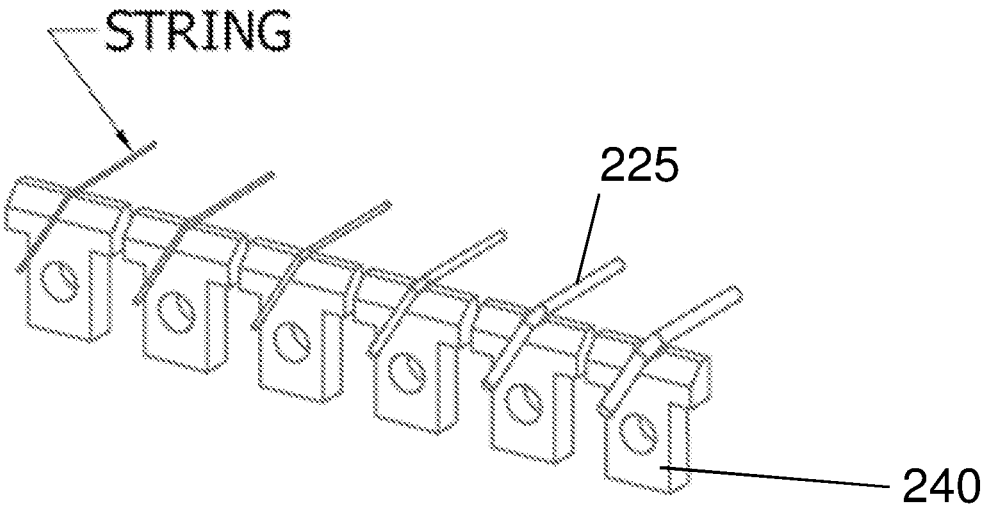
FIG. 2B illustrates isometric views of exemplary saddles with and without strings arranged thereon in accordance with aspects of the present invention.
Figure 2B:
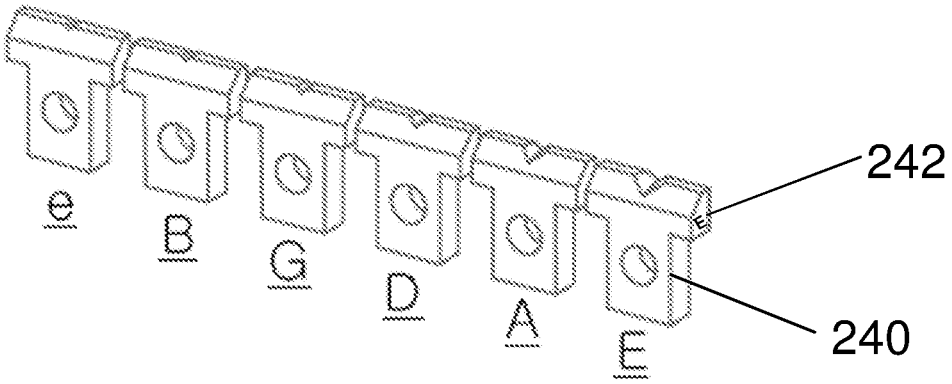

FIG. 2B illustrates isometric views of exemplary saddles 240 with and without strings 225 arranged thereon in accordance with aspects of the present invention. As should be understood, with this example, the six saddles 240 are respectively labeled e, B, G, D, A, and E, corresponding to the respective open notes of an exemplary standard-tuned guitar. In embodiments, each of the six saddles 240 include an identifier 242 corresponding to the respective open note for the particular string-specific saddle 240.

Figure 2C:
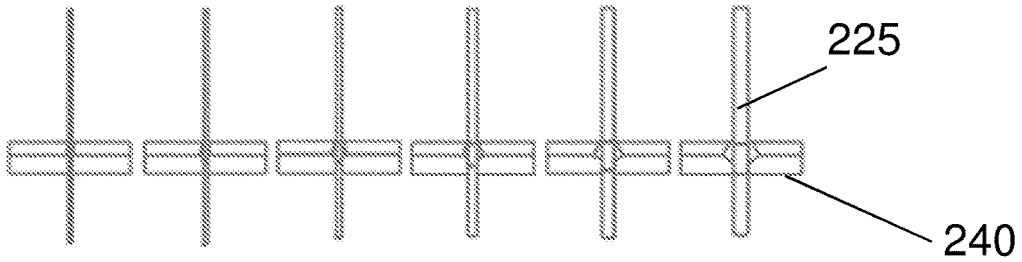
FIG. 2C illustrates top and side views of exemplary saddles with strings arranged thereon in accordance with aspects of the present invention.
Figure 2C:
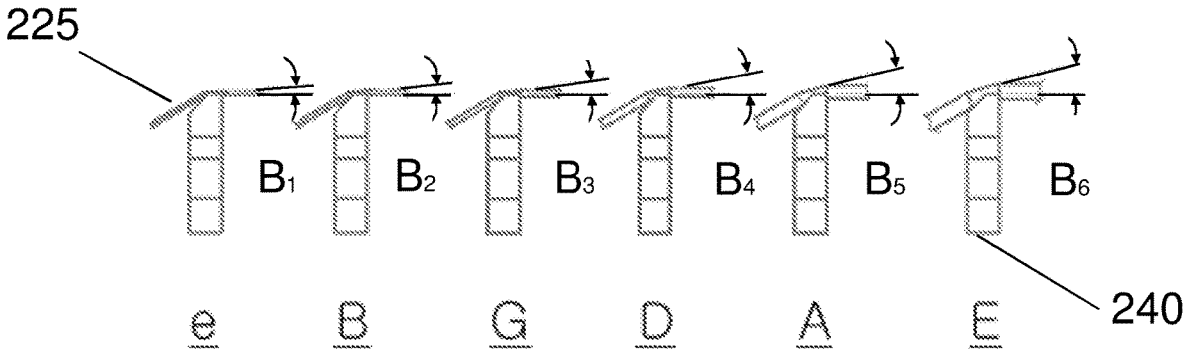

FIG. 2C illustrates top and side views of exemplary saddles with strings arranged thereon in accordance with aspects of the present invention. As shown in FIG. 2C, each string-specific saddle is structured to accommodate a specific string 225 (e.g., a specific gauge string). Additionally, as illustrated in FIG. 2C, in embodiments, the angle B (i.e., $B_1$-$B_6$) may vary for the respective string-specific saddles 240. For example, in one non-limiting exemplary embodiment, the angles may be structured as follows: $B_1$=4.470°; $B_2$=5.807°; $B_3$=7.547°; $B_4$=10.361°; $B_5$=14.948°; and $B_6$=15.318°.

Figure 2D:
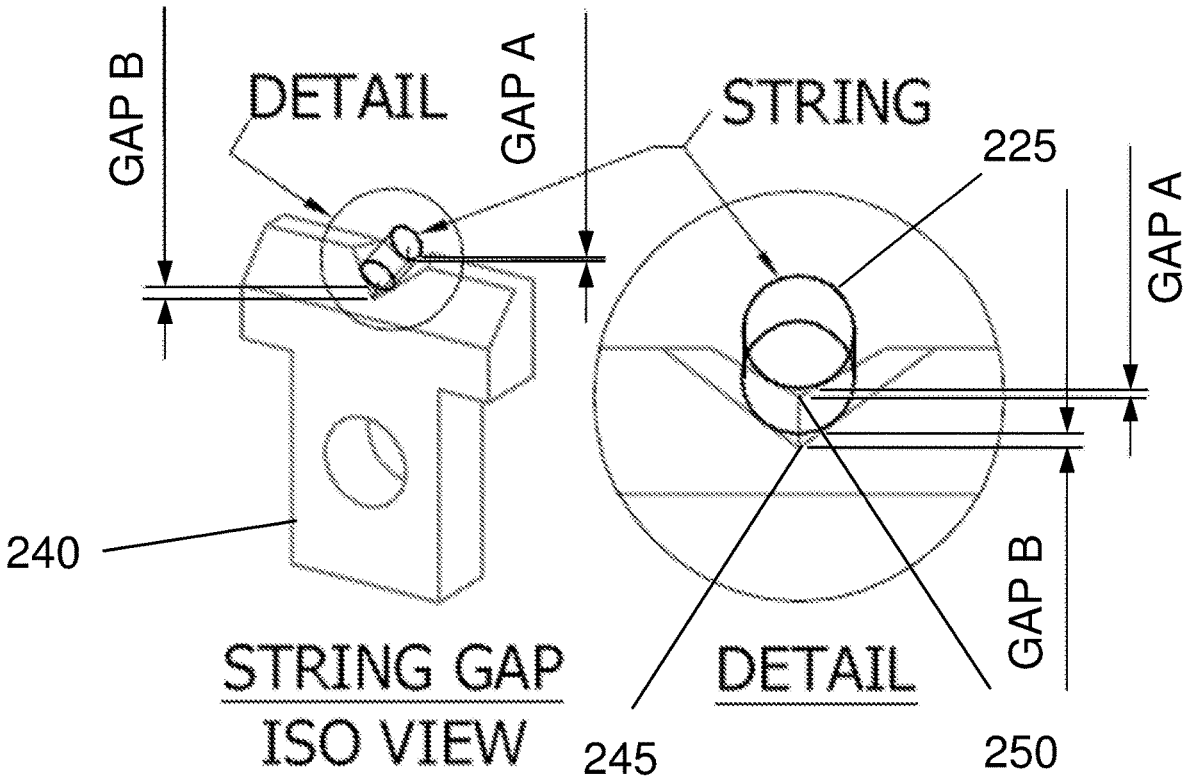
FIG. 2D illustrates an isometric view and a detail view of an exemplary saddle with a string arranged thereon in accordance with aspects of the present invention.

FIG. 2D illustrates an isometric view and a detail view of an exemplary saddle 240 with a string 225 arranged thereon in accordance with aspects of the present invention. As shown in FIG. 2D, the notch 205 in the saddle 240 is structured to provide a gap (i.e., gap A) between the string 225 and the bottom of the notch 205 at the front (or nut) side 250 of the notch 205, and a gap (i.e., gap B) between the string 225 and the bottom of the notch 205 at the rear side 245 of the notch 205. As shown in the exemplary and non-limiting table of gap sizes, the gaps (i.e., gap A and gap B) may differ for the different strings. Also, as shown in the exemplary and non-limiting table of gap sizes, with the larger diameter strings (e.g., the G string, the D string, the A string, and the E string), in embodiments, gap A may be smaller than gap B. It is important to not allow the string to rest in the bed of the saddle. By configuring the gaps (i.e., gap A and gap B), for example, based on the respective string gauge, the contact area of the string with the saddle reduced, allowing the string to pivot on the front edge of the notch (as well as the back edge of the notch). In accordance with aspects of the invention, this allows a precise point (or points) of contact between the string and the saddle (e.g. at gap A), and helps to eliminates string buzz.

Stabilizing Allen Screw on Bridge

In accordance with further aspects of the invention, the bridge is secured to the bridge posts via an improved stabilizing screw arrangement. In embodiments, the bridge stabilizing screws are positioned to provide a force vector which acts in a direction along (or parallel to) the string tensioning direction (e.g., counter to the string tensioning direction) and a force vector perpendicular (or approximately perpendicular) to the direction of the strings. By implementing this aspect of the present invention, the stabilizing bridge screw provides a more stable bridge-to-guitar connection. For example, the two bridge stabilizing screws provide counteracting force vectors, which provide a more secure and centered bridge-to-guitar connection. Additionally, by stabilizing the bridge, the improved stabilizing screw arrangement works in conjunction with the string specific saddles to maintain constant positioning of the strings.

Figure 3:
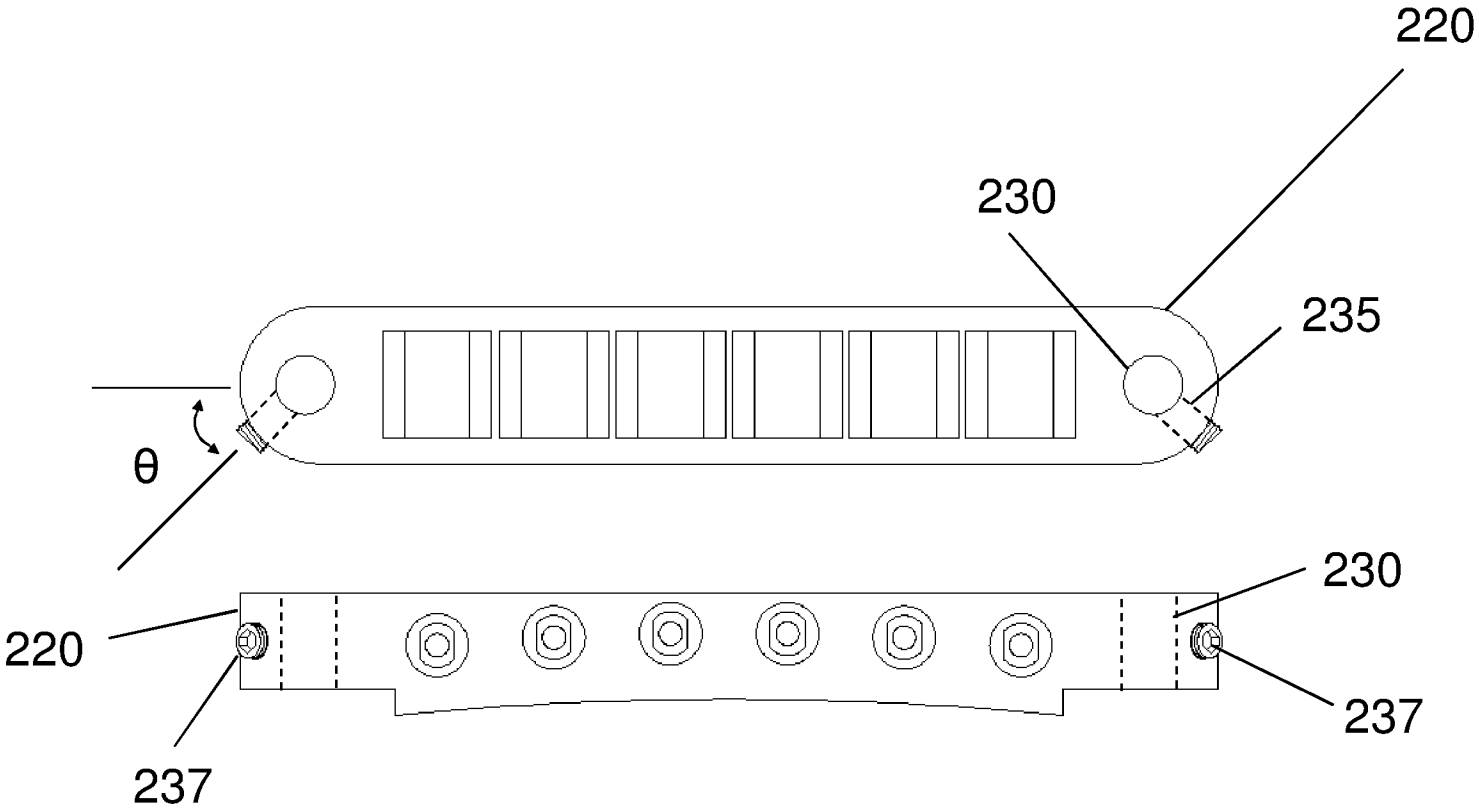
FIG. 3 illustrates top and side views of an exemplary guitar bridge in accordance with aspects of the present invention.
Figure 4:
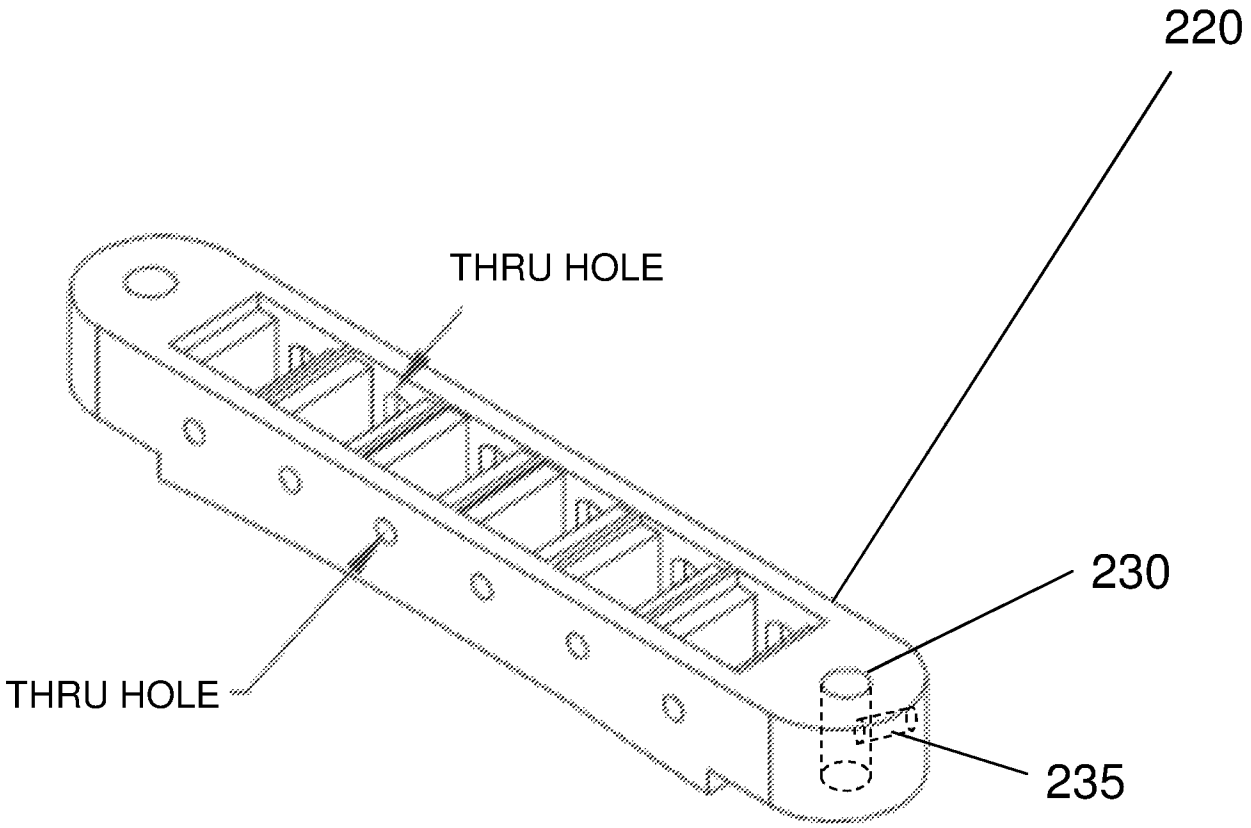
FIG. 4 is an isometric view of an exemplary guitar bridge in accordance with aspects of the present invention.

FIG. 3 illustrates exemplary top and front views of a guitar bridge 220 and FIG. 4 shows an exemplary isometric view of a guitar bridge 220 in accordance with aspects of the present invention. As shown in FIGS. 3 and 4, the bridge 220 includes post holes 230 such that the bridge 220 can be placed on the posts (not shown). The bridge posts are provided on the guitar body, and the bridge 220 is positioned on the bridge posts. For each of the two post holes 230, the bridge 220 includes a screw hole 235 for receiving a stabilizing screw 237 therein. Upon tightening of the two stabilizing screws 237, the bridge 220 is fixedly attached to the bridge posts (and, consequently, to the guitar body). Also, as shown in FIG. 4, the bridge 220 includes thru holes for respectively accommodating intonation screws for adjustment of the saddles.

As illustrated in FIG. 3, in accordance with aspects of the invention, the direction of the stabilizing screws relative to the strings provides a force component in a direction approximately parallel to the string tension direction and a force component parallel to the bridge extension direction (or approximately parallel to the string tensioning direction). That is, in contrast to prior methods, wherein stabilizing screws are arranged parallel to the string direction (and thus, provide no force component in a direction parallel to the bridge extension direction), with the present invention, the stabilizing screws provide an improved bridge-to-post connection. In embodiments, the angular offset Θ of the stabilizing screw direction from a line parallel to the bridge extension direction is approximately 45°±10° in a direction away from the nut of the guitar, with other angular offsets contemplated by the invention. For example, in embodiments, the angular offset of the stabilizing screw direction from a line parallel to the bridge extension direction is approximately 45°±10° in a direction towards the nut of the guitar. In addition to providing a more secure bridge-to-guitar connection, the arrangement of the bridge stabilizing screws at the angular offset allows for easier access to the bridge stabilizing screws, as compared to prior art methods, which may prevent a user from damaging the finish on the guitar while making adjustments.

In accordance with further aspects of the invention, in embodiments, the stabilizing screws 237 are a 2 mm Allen screw, with other size screws (and screw formats) being contemplated without departing from the spirit and scope of the embodiments of the present invention. The inventors have found that the relatively large 2 mm Allen screw size improves stability of the guitar components (and the guitar as a whole) and lessens the possibility of over tightening and/or stripping of components. Additionally, as discussed below, 2 mm Allen screws may be utilized for other components of the bridge and/or stopbar assembly so that a single tool (e.g., a 2 mm Allen wrench) may be used to make multiple adjustments of the bridge and/or stopbar assembly. While the invention contemplates screws of a different dimension (e.g., 2.2 mm) or form (e.g., a Phillips head) may be utilized, in order to allow for the single tool adjustment for the different components, preferably the utilized dimension and form of the screw is the same for each of the components.

Stabilizing Screw on Stopbar

Figure 5:
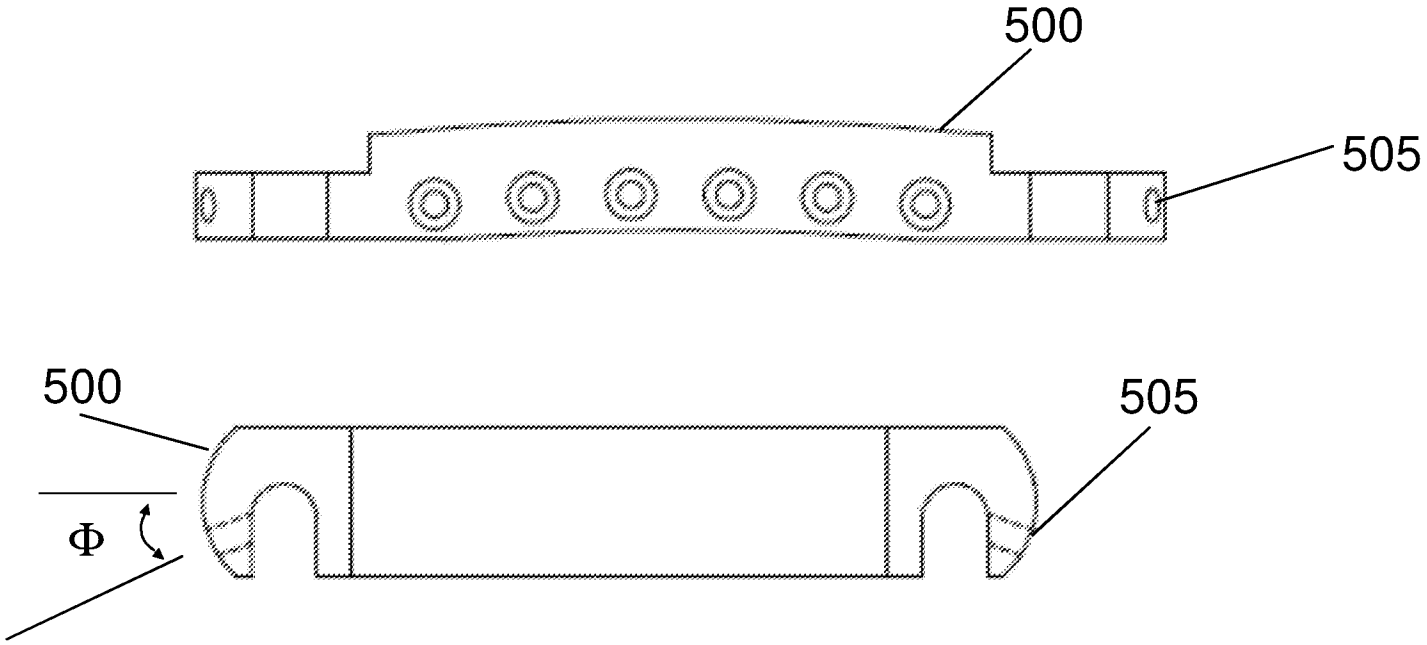
FIG. 5 illustrates top, bottom, front and sectional views of an exemplary guitar tail piece (or stopbar) in accordance with aspects of the present invention.

In accordance with additional aspects of the present invention, a stopbar is secured to the stopbar posts in a manner similar to that of the bridge. FIG. 5 illustrates top and front views of an exemplary guitar tail piece (or stopbar) 500 in accordance with aspects of the present invention (not to scale). As shown in FIG. 5, the stopbar-stabilizing screw holes 505 are positioned such that stabilizing screws (not shown) provide a force vector which acts in a direction parallel to the string tension direction (e.g., counter to the string tensioning direction) and in a direction parallel to the stopbar extension direction. In embodiments, the angular offset Φ of the stabilizing screw direction from a line parallel to the stopbar extension direction is approximately 20°±10° in a direction towards the nut of the guitar, with other angular offsets contemplated by the invention.

In accordance with further aspects of the invention, in embodiments, the stopbar stabilizing screws are a 2 mm Allen screw, with other size screws (and other screw forms) contemplated by present invention. The inventors have found that the relatively large 2 mm Allen screw size improves stability of the guitar and lessens the possibility of over tightening and/or stripping of components. Additionally, as discussed above, 2 mm Allen screws may be utilized for other components of the bridge and/or stopbar assembly so that a single tool (e.g., a 2 mm Allen wrench) may be used to make multiple adjustments of the bridge and/or stopbar assembly.

Intonation Screw on Bridge

Figure 6:
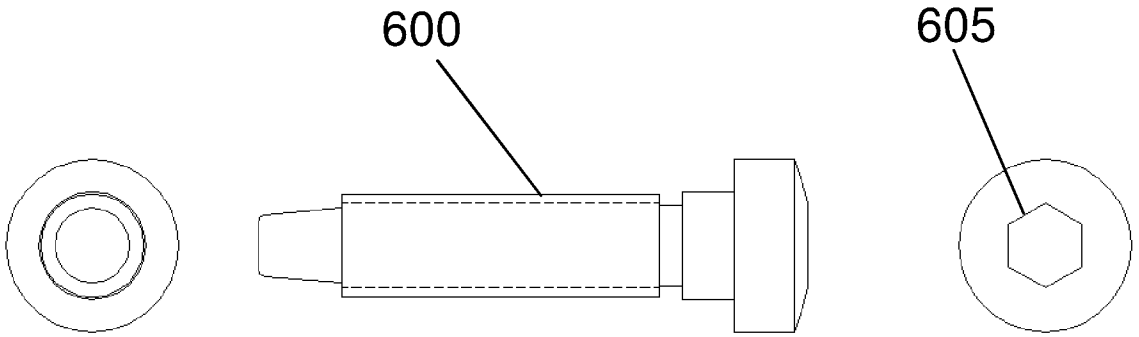
FIG. 6 illustrates exemplary top, bottom, and side views of an intonation screw in accordance with aspects of the present invention.

FIG. 6 illustrates exemplary top, bottom, and side views of an intonation screw 600 in accordance with aspects of the present invention. An intonation screw 600 is used to adjust the position of each saddle within the bridge in a string-extension direction, to alter the effective length of the string, on a string-by-string basis, so as to affect the intonation of the string. In accordance with additional aspects of the invention, the bridge is provided with intonation screws 600 having a size (e.g., socket size) matching the size of the stabilizing screws (e.g., 2 mm Allen screws). By providing intonation screws 600 of matching size, the need for more than one adjustment tool may be eliminated, and the ease and speed of adjustment is improved. Additionally, implementing this aspect of the present invention helps to prevent scarring of guitar finish that can easily occur with convention intonation screws (e.g., standard and Phillips screw adjustments).

Adjustment Post for Bridge

Figures 7A, 7B, 7C, 7D:
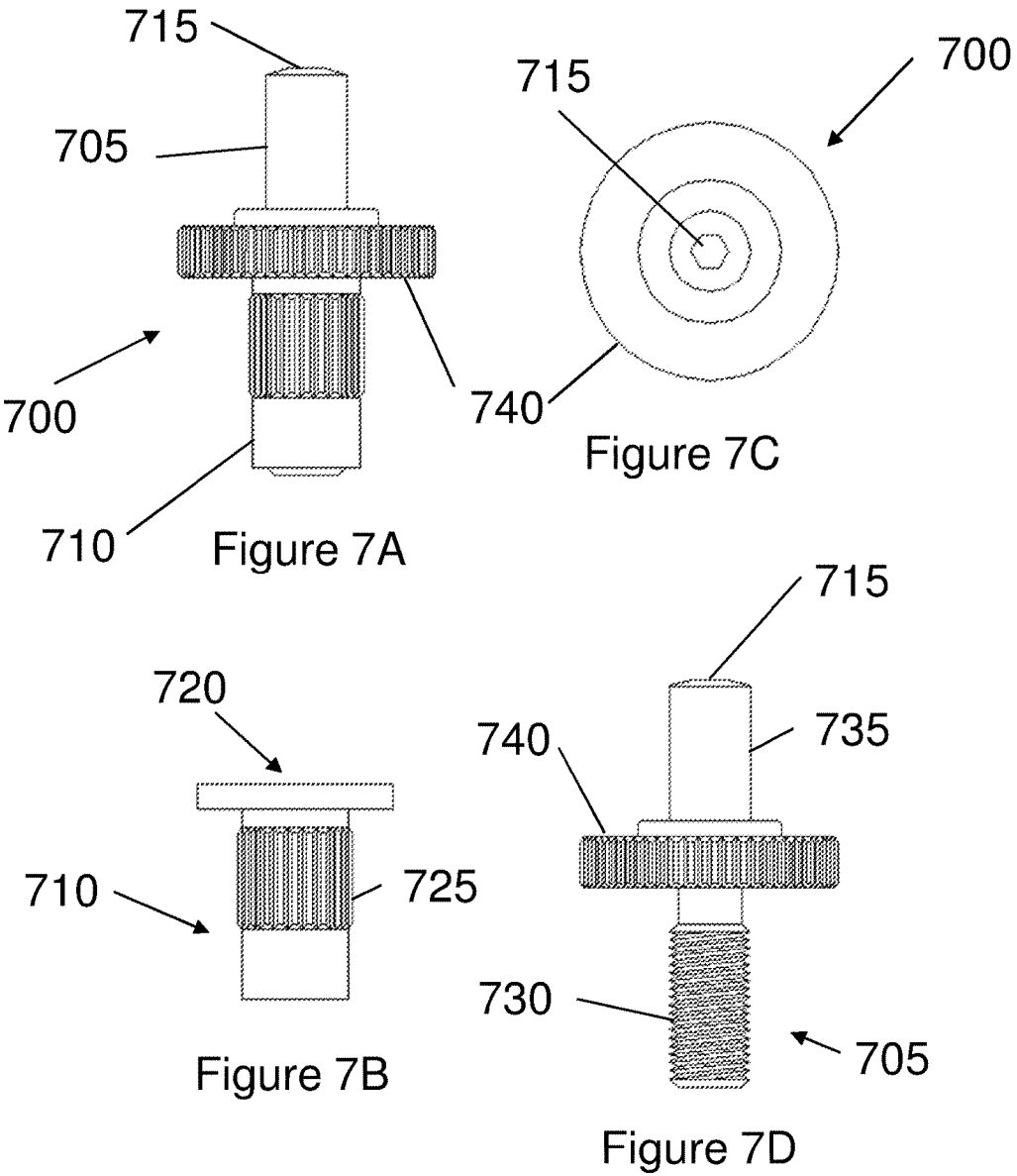
FIGS. 7A-7D illustrate exemplary views of an adjustment post (or portions thereof) in accordance with aspects of the present invention.

FIGS. 7(A)-7(D) illustrate views of components of an exemplary adjustment post assembly 700 in accordance with aspects of the present invention. FIG. 7(A) illustrates a side view of an exemplary adjustment post assembly 700. FIG. 7(B) illustrates a top view of an exemplary adjustment post assembly 700. FIG. 7(C) illustrates a lower portion 710 of the adjustment post assembly 700. As is understood by those of skill in the art, the lower portion 710 (which includes an internally threaded bore 720) is inserted into an appropriately sized cavity in a guitar body (and secured therein with the aid of raised portion 725, and, for example, adhesive). FIG. 7(D) illustrates the upper portion 705 of the adjustment post assembly 700. As is understood by those of skill in the art, the upper portion 705 is connected to the lower portion 710 by inserting the threaded portion 730 into the threaded bore 720. The upper portion 705 includes a bridge post 735 for supporting the bridge.

Two adjustment post assemblies 700 are fitted into the guitar body and the bridge is secured to the guitar via the two adjustment post assemblies 700. Each adjustment post assembly 700 provides for vertical movement (via the threaded bore 720 and the threaded portion 730), such that the entire bridge may be raised or lowered relative to the guitar body, or one side of the bridge may be raised and lowered. Conventionally, adjustment posts are adjusted via a thumbwheel 740 on the adjustment post (which thumbwheel 740 is typically moved with the help of pliers).

In accordance with aspects of the invention, the bridge posts 735 having a larger diameter (as compared to conventional bridge posts) and, e.g., a 2 mm Allen head (or socket) 715 are utilized. For example, a conventional post size is approximately 0.157" in diameter, a conventional receiving hole on the bridge is approximately 0.162" in diameter. With the present invention, however, the inventor has found providing larger bridge posts (and larger bridge and guitar receiving holes) provides greater stability, reduces relative movement between the bridge and the guitar, improves the bridge-to-guitar contact, and reduces vibration. Additionally, the larger bridge posts provide more contact area with the body of the guitar for improved sustain. For example, with a non-limiting exemplary embodiment, the post size is approximately 0.192" in diameter, with the receiving holes on the bridge and the receiving holes on the guitar body approximately 0.193" in diameter.

For example, the larger diameter bridge post provides a stronger base for the bridge, and is less likely to suffer breakage. The adjustment post assembly 700 allows for ease and speed of adjustment. For example, the Allen head 715 (or socket) allows for height adjustment of the bridge post 735 from top (in addition to the adjustment provided by the thumbwheel 740). The adjustment post assembly 700 helps prevent scarring of guitar finish that occurs with thumbwheel adjustment via pliers. That is, with a convention thumbwheel arrangement, when the guitar is strung, pliers may be required to move the thumbwheel in order to adjust the bridge. With the present invention, however, by adjusting the height of the bridge posts 735 from the top via the Allen head 715 using, for example, an Allen wrench, such potential for scarring of guitar finish can be avoided.

Additionally, as discussed above, bridge posts 735 having a 2 mm Allen head 715 may be utilized for the adjustment posts so that a single tool (e.g., a 2 mm Allen wrench) may be used to make multiple adjustments of the bridge and/or stopbar assembly.

While the invention has been described with reference to specific embodiments, those skilled in the art will understand that various changes may be made and equivalents may be substituted for elements thereof without departing from the true spirit and scope of the invention. In addition, modifications may be made without departing from the essential teachings of the invention.

For example, while the present invention has been described as string-specific saddles for a guitar bridge, and rigidly mounted guitar bridges and stopbars (or tailpieces) that become fixedly mounted to the body of a guitar, the invention contemplates providing these features separately. For example, the invention contemplates providing string-specific saddles for a floating (or tremolo) bridge. Additionally, for example, the invention contemplates providing the improved bridge and stabilizing screw arrangement for a bridge that does not utilize saddles. Also, some guitar combine the bridge and the stopbar (e.g., a compensating bridge). The invention contemplates that the universally sized adjustment screws could be used with such an arrangement (i.e., the compensating bridge). Furthermore, some guitars do not utilize a stopbar (or tail piece), but instead use the holes in the body of the guitar itself to secure the ends of the strings. For such a guitar, the invention contemplates, for example, providing the string specific saddles and/or the improved bridge and stabilizing screw arrangement, but not the improved stopbar.

What is claimed is:

1. An adjustment post assembly for a bridge for a stringed instrument, the adjustment post assembly comprising:

a lower portion configured for insertion in a cavity of the stringed instrument and having an internally-threaded bore; and an upper portion having a threaded portion structured and arranged for threaded engagement with the internally-threaded bore and a bridge post configured for supporting one end of the bridge, wherein the bridge post includes a socket therein structured and arranged for adjusting a height of the upper portion relative to the lower portion.

2. The adjustment post assembly of claim 1, wherein the socket is configured as a hexagonal socket.

3. The adjustment post assembly of claim 1, wherein the socket is configured as a Phillips socket.

4. A bridge assembly for a stringed instrument, the bridge assembly comprising:

a stringed instrument bridge; and a plurality of adjustment post assemblies, wherein each of the plurality of adjustment post assemblies comprises:

a lower portion having an internally-threaded bore; and an upper portion having a threaded portion structured and arranged for threaded engagement with the internally-threaded bore and a bridge post configured for supporting one end of the stringed instrument bridge; and wherein the bridge post includes a socket structured and arranged for adjusting a height of the upper portion relative to the lower portion of the respective adjustment post.

5. The bridge assembly of claim 4, wherein the socket is configured as a hexagonal socket.

6. The bridge assembly of claim 4, wherein the socket is configured as a Phillips socket.

7. A bridge assembly for a stringed instrument, the bridge assembly comprising:

a stringed instrument bridge;

a plurality of saddles arranged within the stringed instrument bridge, a plurality of intonation screws, each of the plurality of intonation screws having an intonation adjustment socket;

two adjustment post assemblies, each of the adjustment post assemblies having an adjustment post socket, two stabilizing screws operable to releaseably secure the stringed instrument bridge to the two adjustment post assemblies, respectively, each of the two stabilizing screws having a stabilizing screw socket, wherein the two stabilizing screws are structured and arranged such that respective longitudinal axes of the two stabilizing screws are arranged at an angular offset relative to a string extension direction, and wherein each of the intonation adjustment sockets, the adjustment post sockets, and the stabilizing screw sockets have a commonly-sized socket.

8. The bridge assembly of claim 7, wherein each of the intonation adjustment sockets, the adjustment post sockets, and the stabilizing screw sockets are configured as hexagonal sockets.

9. The bridge assembly of claim 7, wherein each of the intonation adjustment sockets, the adjustment post sockets, and the stabilizing screw sockets are configured as Phillips sockets.

10. A stringed instrument bridge assembly for a stringed instrument, the bridge assembly comprising:

a stringed instrument bridge;

a plurality of saddles arranged within the stringed instrument bridge, a plurality of intonation screws, each of the plurality of intonation screws having an intonation adjustment socket; and two adjustment post assemblies, each of the adjustment post assemblies having an adjustment post socket structured and arranged for adjusting a height of an upper portion of the respective adjustment post relative to a lower portion of the respective adjustment post, wherein each of the intonation adjustment sockets and the adjustment post sockets have a same-sized socket.

11. The bridge assembly of claim 10, wherein each of the intonation adjustment sockets and the adjustment post sockets are configured as hexagonal sockets.

12. The bridge assembly of claim 10, wherein each of the intonation adjustment sockets and the adjustment post sockets are configured as Phillips sockets.

13. A method of adjusting a height of an adjustment post assembly for a bridge for a stringed instrument, the adjustment post assembly comprising:

a lower portion configured for insertion in a cavity of the stringed instrument and having an internally-threaded bore; and an upper portion having a threaded portion structured and arranged for threaded engagement with the internally-threaded bore and a bridge post configured for supporting one end of the bridge, wherein the bridge post includes a socket therein structured and arranged for adjusting a height of the upper portion relative to the lower portion, the method comprising:

inserting an adjustment tool into the socket; and turning or rotating the adjustment tool to adjust the position of the upper portion relative to the lower portion.

14. The method of claim 13, wherein the inserting is in a direction along a longitudinal axis of the bridge post.

15. A method of adjusting a height of a bridge assembly for a stringed instrument, the bridge assembly comprising:

a stringed instrument bridge; and a plurality of adjustment post assemblies, wherein each of the plurality of adjustment post assemblies comprises:

a lower portion having an internally-threaded bore; and an upper portion having a threaded portion structured and arranged for threaded engagement with the internally-threaded bore and a bridge post configured for supporting one end of the stringed instrument bridge; and wherein the bridge post includes a socket structured and arranged for adjusting a height of the upper portion relative to the lower portion of the respective adjustment post, the method comprising:

inserting an adjustment tool into at least one of the sockets of the respective bridge posts; and turning or rotating the adjustment tool to adjust the position of the upper portion relative to the lower portion of the respective adjustment post assemblies.

16. The method of claim 15, wherein the inserting is in a direction along a longitudinal axis of the bridge post.

17. A method of assembling a bridge assembly for a stringed instrument on the stringed instrument, the bridge assembly comprising a plurality of adjustment post assemblies, wherein each of the plurality of adjustment post assemblies comprises:

a lower portion having an internally-threaded bore; and an upper portion having a threaded portion structured and arranged for threaded engagement with the internally-threaded bore and a bridge post configured for supporting one end of the stringed instrument bridge; and wherein the bridge post includes a socket structured and arranged for adjusting a height of the upper portion relative to the lower portion of the respective adjustment post, the method comprising:

inserting the lower portion into a cavity on the stringed instrument;

inserting the threaded portion of the upper portion into the internally-threaded bore;

inserting an adjustment tool into the socket; and turning or rotating the adjustment tool to adjust the position of the upper portion relative to the lower portion.

18. The method of claim 17, wherein the bridge assembly further comprises a stringed instrument bridge, the method further comprising arranging the stringed instrument bridge on the plurality of adjustment post assemblies.

* * * * *